US005419093A

United States Patent [19]

Wei

[11] Patent Number: 5,419,093

[45] Date of Patent: May 30, 1995

[54] VERSATILE ALUMINUM ALLOY MOLDING BLOCK STRUCTURE

[76] Inventor: Shih C. Wei, No. 87-2, Chiaonan St., Yensui, Tainan, Taiwan, Prov. of China

[21] Appl. No.: 111,487

[22] Filed: Aug. 25, 1993

[51] Int. Cl.[6] ..... E04C 2/34

[52] U.S. Cl. ..... 52/806; 52/126.6; 52/220.3; 52/785; 52/794; 428/73

[58] Field of Search ..... 52/806, 807, 808, 585.1, 52/590.1, 590.2, 785, 794, 817, 818, 220.3, 126.6; 428/73, 138

[56] References Cited

U.S. PATENT DOCUMENTS

| | | | |
|---|---|---|---|
| 899,410 | 9/1908 | Kilbride | 52/590.1 |
| 1,852,715 | 4/1932 | Greenebaum | 52/590.1 |
| 2,528,049 | 10/1950 | Gonda | 428/138 |
| 3,496,052 | 2/1970 | Odenthal | 428/73 |
| 3,623,936 | 11/1971 | Hotz | 52/806 |
| 4,130,682 | 12/1978 | Lauko | 428/138 |
| 4,706,422 | 11/1987 | Ashton | 52/818 |
| 5,273,806 | 12/1993 | Lockshaw et al. | 52/806 |

*Primary Examiner*—Carl D. Friedman
*Assistant Examiner*—Kien Nguyen
*Attorney, Agent, or Firm*—Bacon & Thomas

[57] ABSTRACT

A versatile aluminum alloy molding block structure for used as a ceiling tile, a floor covering or a wall covering, particularly a molding block with patterns and designs on the surface to be used as a building material. The aluminum alloy molding block consists of a basic block and surface boards covering the surface of said basic block. The basic block has a plurality of partitions having the shape of bee nests contained therein, each of the partitions can be packed with fire proofing material, heat insulator or acoustical, soundproofing material. It is scientific and economical to use the aluminum alloy molding blocks as a versatile building material.

9 Claims, 7 Drawing Sheets

VERSATILE ALUMINUM ALLOY MOLDING BLOCK STRUCTURE

BACKGROUND OF THE INVENTION (a) Field of the Invention

The present invention relates to the structure of an aluminum alloy molding block, and more particularly, to the structure of an aluminum alloy molding block that can be used as a building material in a ceiling, a wall covering or a floor covering.

(b) Description of the Prior Art

Conventionally, mortar and cement are used as building materials for ceilings, walls and flooring. Such work requires experience masonry personnel to handle, therefore, the cost are high and the manufacturing of such building materials cannot be by mechanical equipment. If a certain portion of the building structure has to be removed, the overall appearance of the structure is destroyed.

It is not easy to find experienced carpenters in our modern society, therefore, the construction work that requires carpentry are getting delay for completion.

The surface of the wall is secured by an inserted pin which has the following drawbacks:

1. The resistance to wind is poor and the pulling strength is insufficient, causing the stone materials to fall off easily.
2. The cement wall makes the building structure unsafe during an earthquake. Hence, a light weight, sturdy and versatile molding blocks is in great demand for the general public.
3. A conventional high-rise building usually have tiles of stone materials attached to the surface of the cement wall. Rains can cause the lime to penetrate into the surface of the wall. Thus, the overall appearance of the building is destroyed.

SUMMARY OF THE INVENTION

The main object according to the present invention is to provide a structure for a versatile aluminum molding block which can be used in the ceiling, the wall or the floor. Such molding block has a number of bee nest shaped divider contained therein for improving the bending strength of the structure.

The secondary object according to the present invention is to provide a structure for a versatile aluminum molding block which can be used in the ceiling, the wall or the floor. The bee nest shaped divider contained in the structure can be filled up with fire-proof material, heat insulator or acoustical, soundproofing material for versatility features.

A further object according to the present invention is to provide a structure for an aluminum molding block which can be used in the ceiling, the wall or the floor. The bee nest shaped divider contained in the structure can be hooked onto the ceiling.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 3:
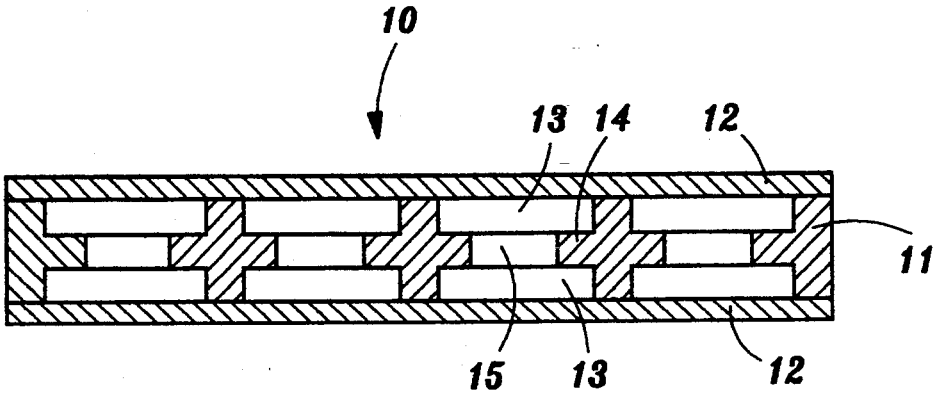
FIG. 3 is a vertical cross-sectional view along the line 3—3 of the structure in FIG. 1 according to the present invention.
Figure 1:
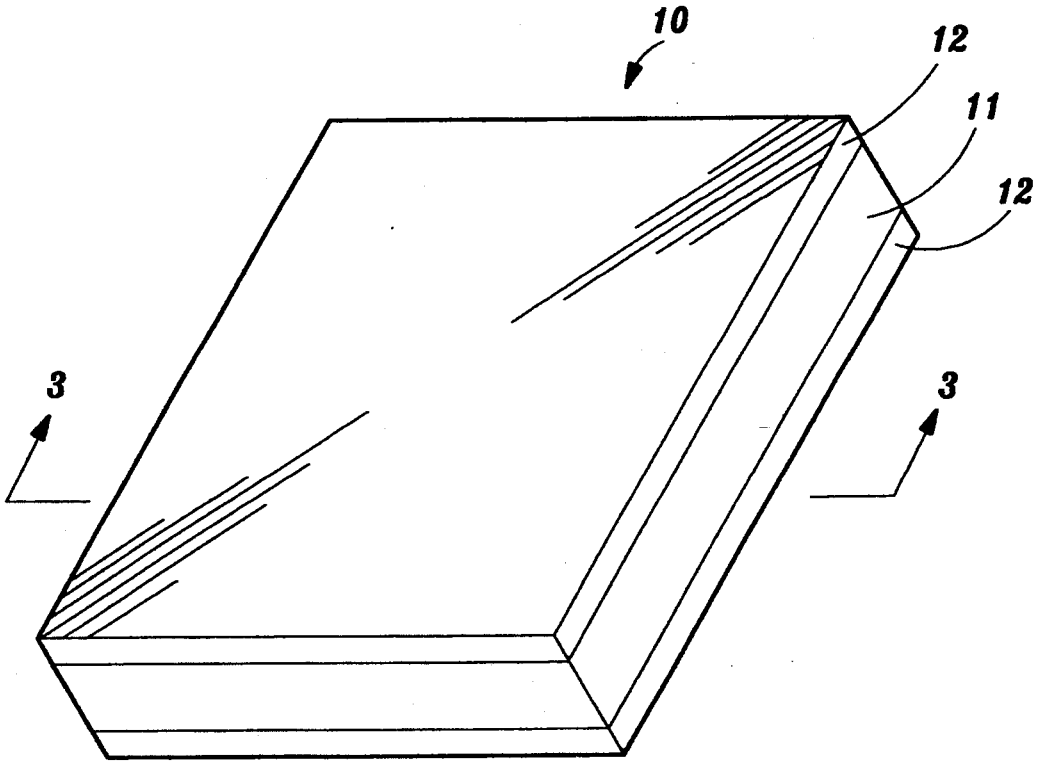
FIG. 1 is a perspective view of the structure of the versatile aluminum molding block according to the present invention.
Figure 2:
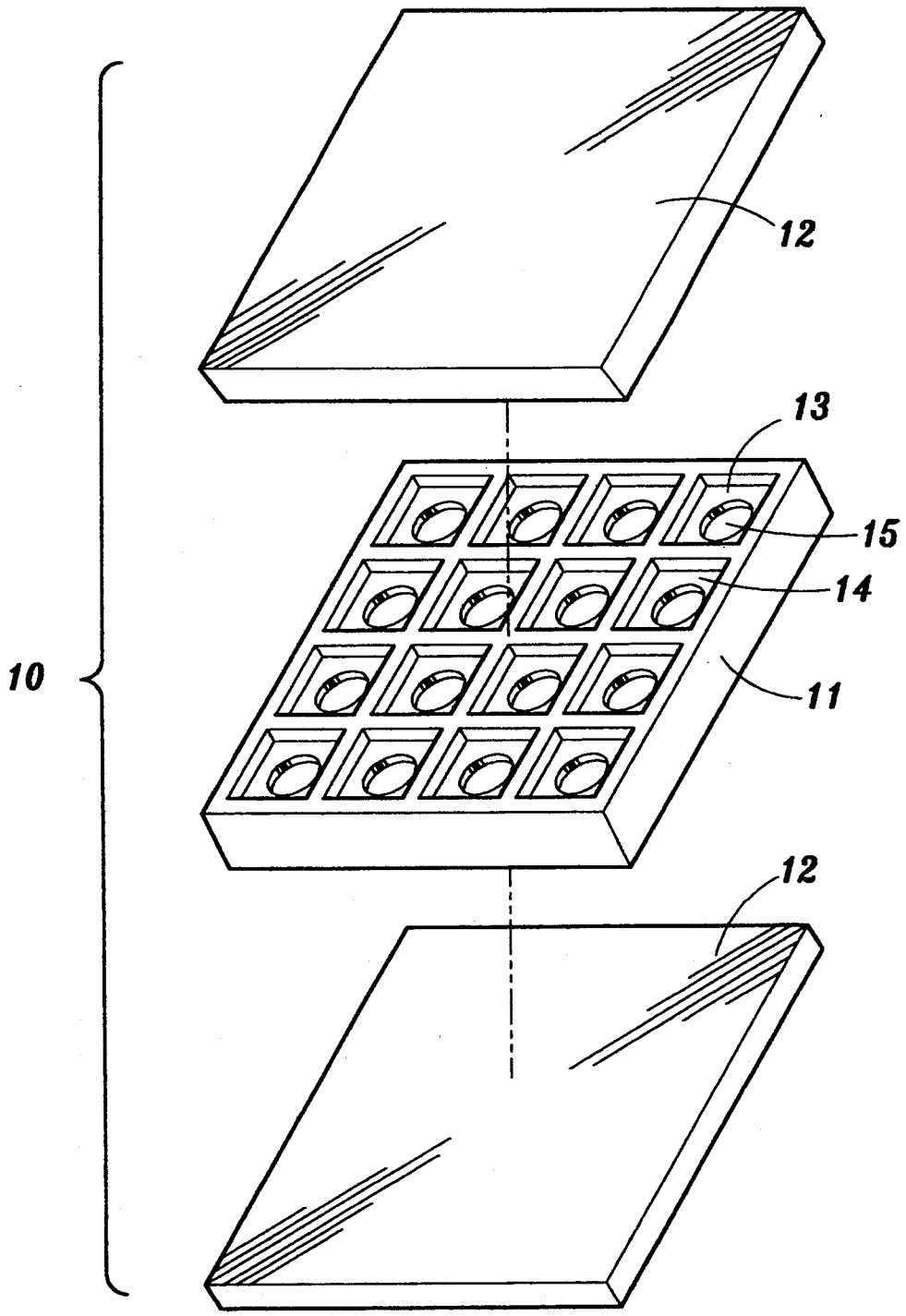
FIG. 2 is a perspective fragmented view of the structure of the versatile aluminum molding block according to the present invention.
Figure 4:
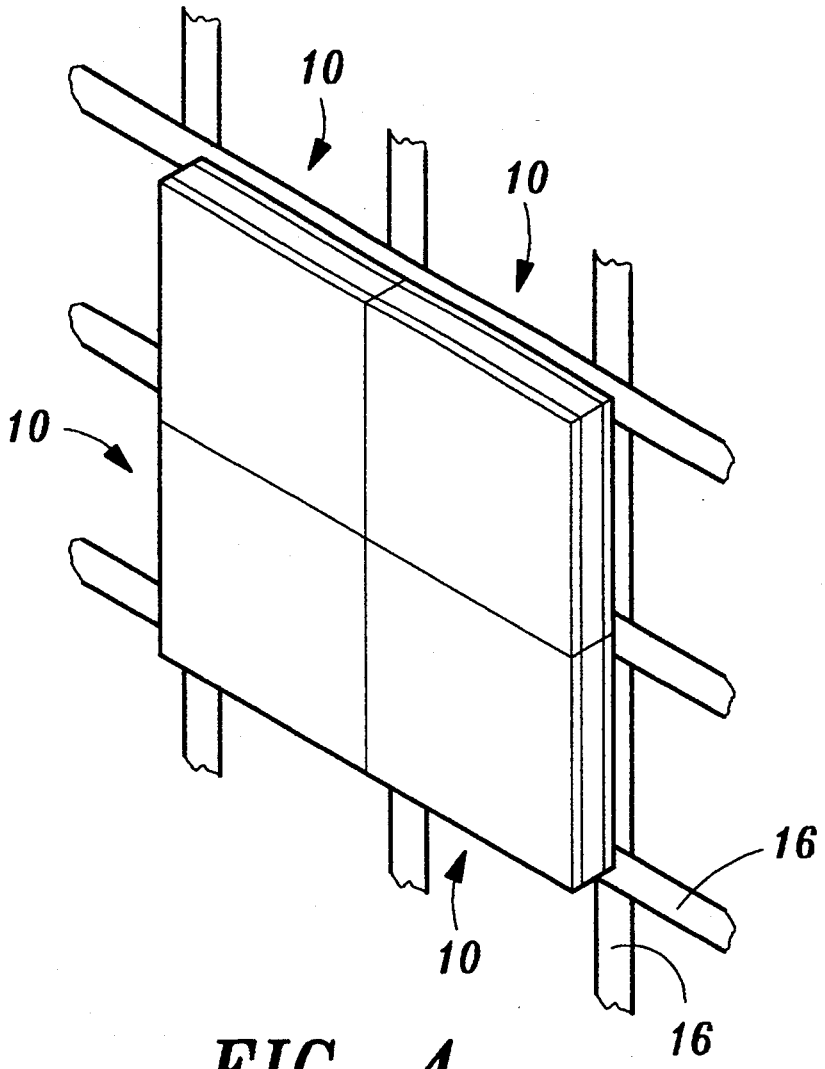
FIG. 4 is a diagrammatic view of the versatile molding blocks used as a ceiling tile according to the present invention.

Please refer to FIGS. 1, 2, 3 and 4 for the structure of the aluminum alloy molding block according to the present invention. Such molding block structure 10 consists of a basic block 11 and a surface board 12, which is used to cover up the top and bottom of the basic block 11. The surface board 12 can be made out of a variety of materials such as wood, vinyl, carpet or ceramic tile. It is a choice for an individual to select the type of materials used. The basic block 11 is a one-piece body constructed from aluminum alloy, it has the advantages of corrosion resistance, light weight, sturdy, durable and is easy to work with. The basic block 11 has a plurality of recesses 13 which are formed in bee-nest shape contained therein. A dividing board 14 is located in each of the recesses 13, each of the dividing boards 14 has a feed through hole 15. The recesses 13 can either be packed with fire proofing material, heat insulator or acoustical, soundproofing material. Adhesives are then applied to the exterior surface of the basic block 11, a few minutes later, the surface board 12 with appropriate material can be adhered onto the exterior surface of the basic block 11. This completes the finished structure of the versatile aluminum alloy molding block 10. In use, the molding block 10 can be placed on a conventional suspended ceiling 16. It is advantageous that the suspended ceiling 16 does not have to be removed. The ceiling can be remodeled simply by replacing the old conventional ceiling tile with the new aluminum alloy molding block 10. It is practical and economical to be able to save the existing frame structure by using the structure according to the present invention.

Figure 5:
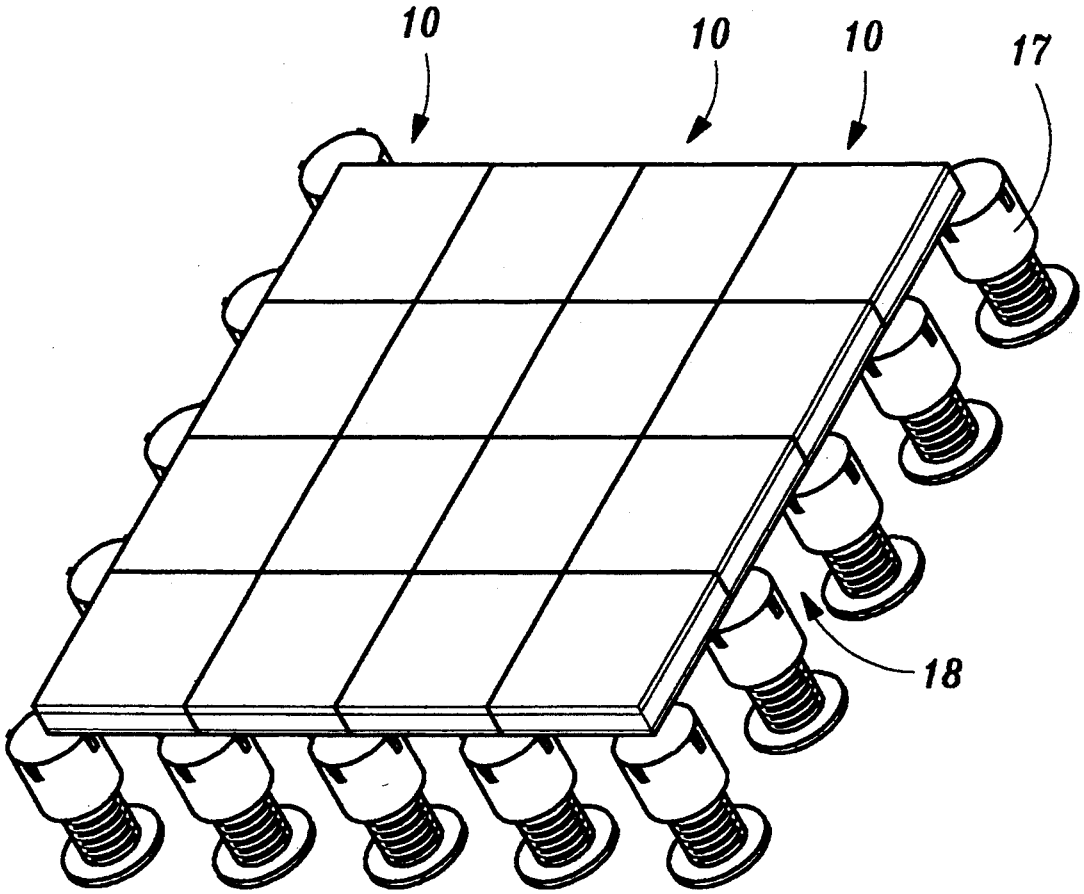
FIG. 5 is a diagrammatic view of the versatile molding blocks used as a floor tile according to the present invention.

Referring to FIG. 5, which shows an embodiment of the molding block 10 used as a floor covering. An adjustable height supporting frame 17 is readily available which can be placed on the floor. The aluminum alloy molding blocks 10 are then set on top of the supporting frame 17. The colors and patterns on the molding blocks 10 can be changed based on season and environment. In addition, all the electrical wiring and cables can be buried in the space 18 in between the supporting frame 17 and the ground floor. This gives a versatility and a decorating effects to the inside environment.

Figure 7:
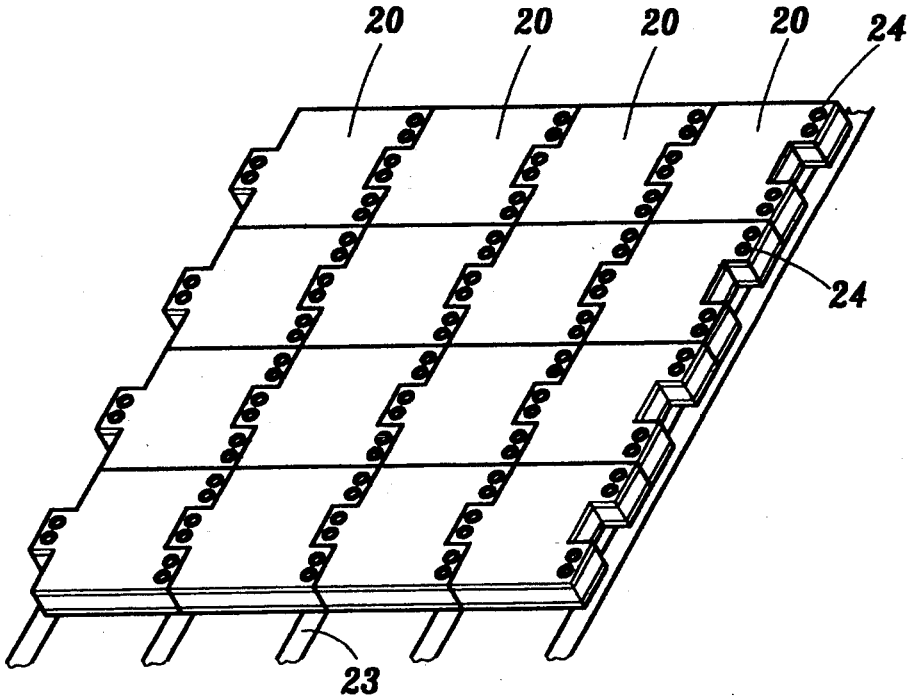
FIG. 7 is a diagrammatic view of a number of basic blocks in FIG. 6 assembled and installed on a steel frame according to the present invention.
Figure 6:
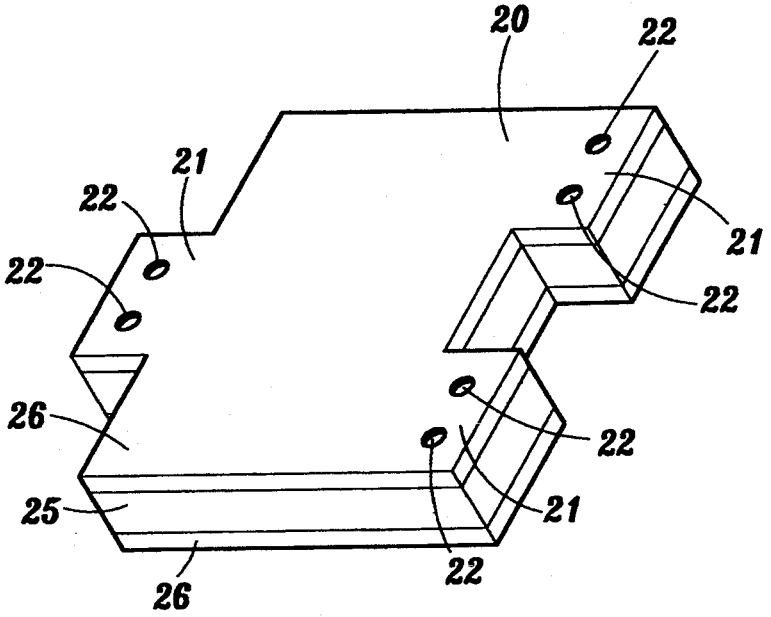
FIG. 6 is a perspective view of the basic block of the molding blocks used as a wall tile according to the present invention.

Referring to FIG. 6 and 7, which shows another embodiment of the structure of an aluminum alloy molding block 20 used as a wall covering. This molding block 20 consists of a basic block 25 and a surface board 26 which is basically similar to the aforesaid structure. The major difference between the molding block 20 and the molding block 10 is their bonding. In One edge of the molding block 20 has a protruded portion 21 located at center, the opposite edge of the molding block 20 has two other protruded portions 21 with one at each end. A plurality of screw holes 22 are opened on each of the protruded portion 21. A number of molding blocks 20 are laid down on top of a conventional steel frame 23, then a plurality of screw members 24 are used to screw the molding blocks 20 onto the steel frame 23. Each of the molding blocks 20 are then joint and screwed together to complete a wall surface as shown in FIG. 7. Pressed strips or silicone are then adhered or applied to the joints and gaps to finish the wall covering with a smooth and elaborate surface. The finished wall covering can be attached to a wall or used as a room partition. Its decorative patterns on the surface enhance the appearance of the room.

Figure 8:
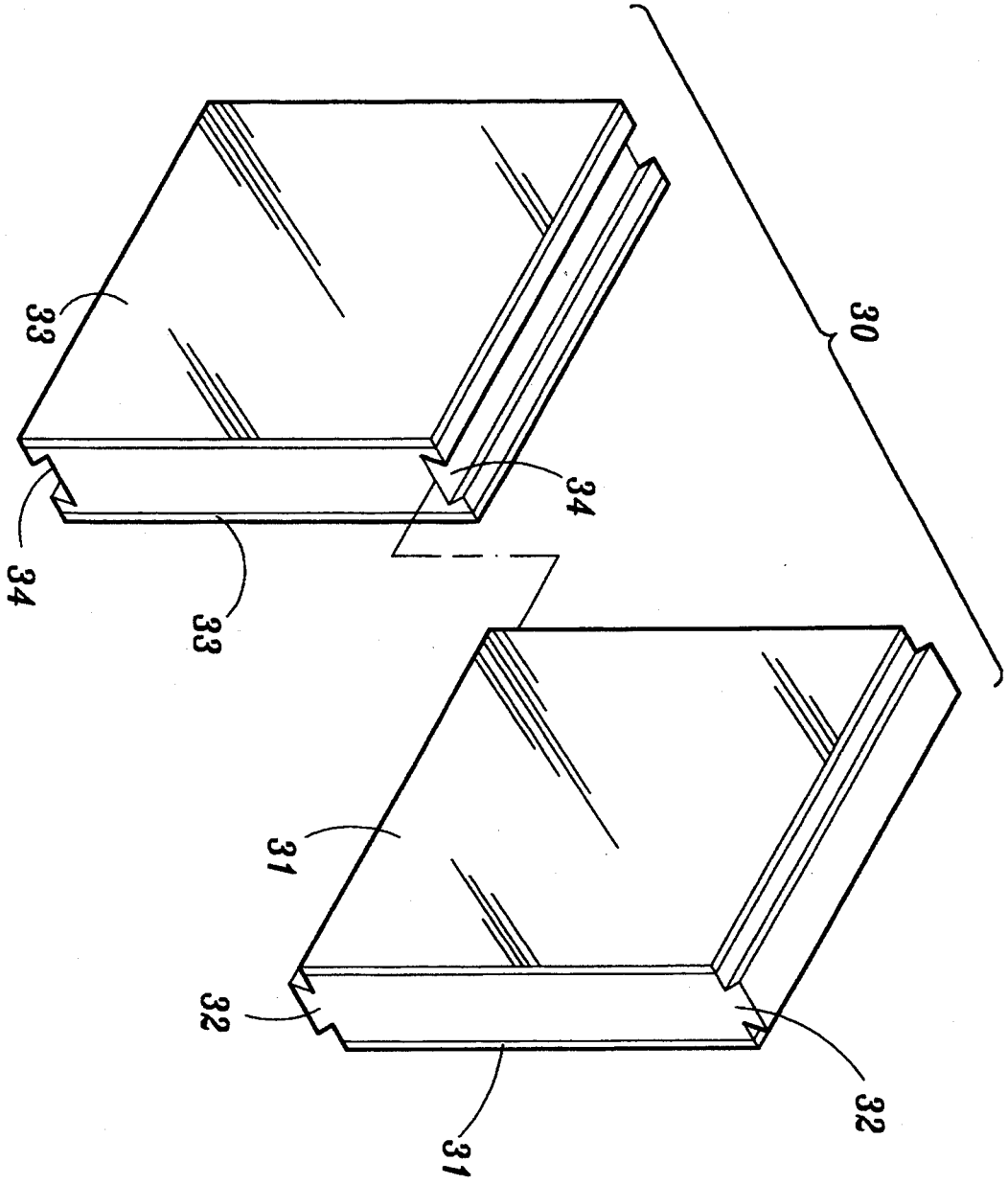
FIG. 8 is a perspective view of the basic blocks A and B to be used in the exterior wall of a building according to the present invention.
Figure 9:
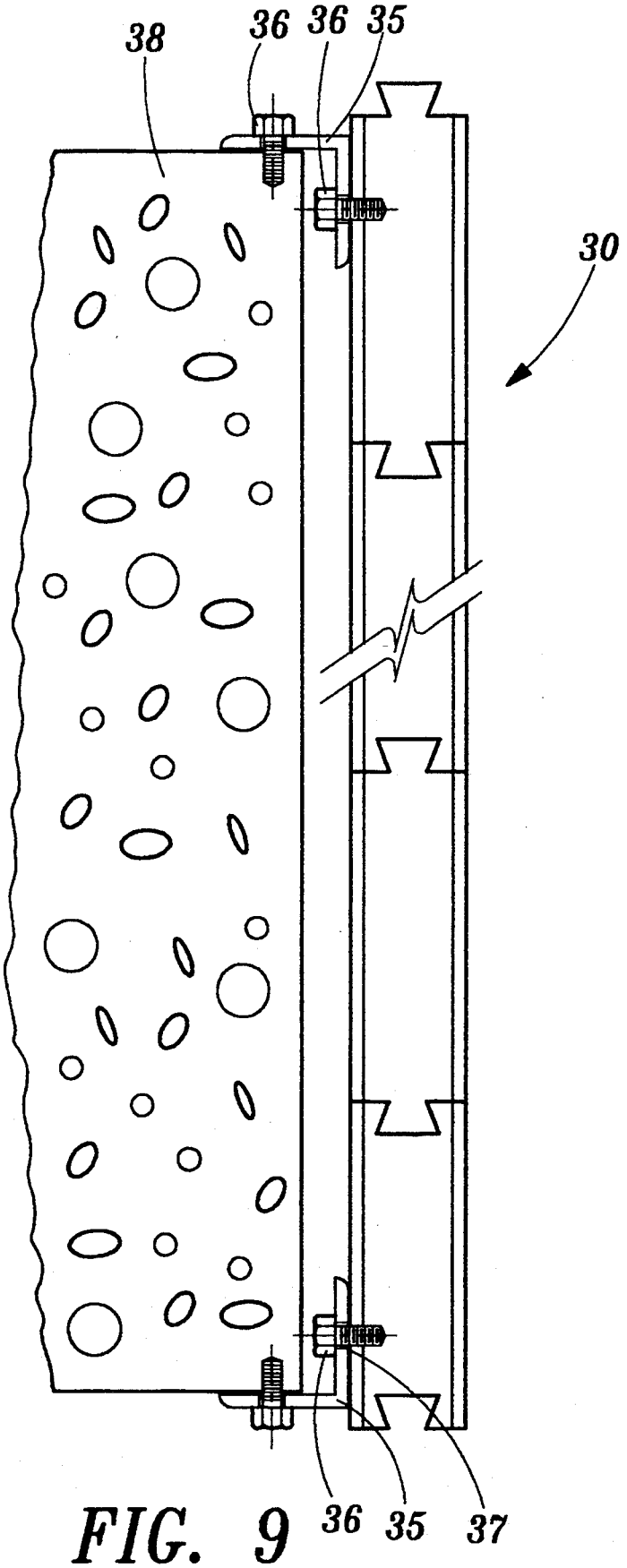
FIG. 9 is a diagrammatic view of the basic blocks A and B assembled together and installed in a an exterior wall.

Referring to FIGS. 8 and 9 for another structure of the molding block 30 used in the exterior wall of a building. This molding block 30 consists of a basic block 31, a basic block 33 and a surface board. It is basically similar to the above molding block structure except that the basic block 31 has a tongue portion 32 on both edges while the basic block 33 has a groove portion 34 on the corresponding edges. By such configuration, the tongue portion 32 can be inserted into the groove portion 34 so that they can be fitted together. In addition, the basic blocks 31 and 33 can be assembled based on the actual size required. After assembled, the joints can be rewelded together to give a sturdy structure. When placed in the exterior wall of the building for installation, the four corners of the aluminum alloy molding block 30 is braced by L-shaped brackets 35. Fasteners 36 are used to feed through the fixed holes 37 so as to fasten the molding blocks 30 onto the exterior wall 38.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. An alloy molding block structure comprising:
   a) a basic block formed of molded material and having opposite faces;
   b) a plurality of recesses defined by each of the opposite faces;
   c) a dividing board extending across each of the recess, each dividing board having a feed through hole extending therethrough so as to communicate with recesses on opposite faces of the basic block; and
   d) a surface board attached to each of the opposite faces so as to cover all of the recesses.

2. The alloy molding block structure of claim 1 wherein the basic block is formed of molded aluminum alloy.

3. The alloy molding block structure of claim 1 wherein each recess has a quadrangular configuration.

4. The alloy molding block structure of claim 1 wherein each feed through hole has a circular configuration.

5. The alloy molding block structure of claim 1 wherein the basic block has a quadrangular configuration with a first pair of opposite sides and further comprising:
   a) a first protrusion extending from a center portion of one of the first pair of opposite sides;
   b) two second protrusions extending from end portions of the other of the first pair of opposite sides; and,
   c) a second pair of opposite sides of the basic block, each of the second pair of opposite sides having a straight, planar configuration.

6. The alloy molding block structure of claim 5 wherein each protrusion has a rectangular configuration.

7. The alloy molding block structure of claim 5 wherein each protrusion defines at least one hole configured to receive a fastener therein.

8. The alloy molding block structure of claim 1 wherein the basic block has a quadrangular configuration comprising:
   a) a first pair of opposite sides each having therein a dove tail groove; and
   b) a second pair of opposite sides, each having a straight, planar configuration.

9. The alloy molding block structure of claim 1 wherein the basic block has a quadrangular configuration, comprising:
   a) a first pair of opposite sides, each having a tongue projecting therefrom and extending along the length thereof; and
   b) a second pair of opposite sides, each having a straight, planar configuration.

* * * * *